US006149394A

United States Patent [19]

Allen

[11] Patent Number: 6,149,394

[45] Date of Patent: Nov. 21, 2000

[54] OCCLUSION DETECTION MEANS FOR A PERSISTALTIC PUMP

[76] Inventor: Alton K. Allen, 255 E. 2nd St., Mineola, N.Y. 11501

[21] Appl. No.: 09/259,119

[22] Filed: Feb. 26, 1999

[51] Int. Cl.[7] ..... F04B 49/00

[52] U.S. Cl. ..... 417/63

[58] Field of Search ..... 417/63, 477.1; 604/153

[56] References Cited

U.S. PATENT DOCUMENTS 4,702,675 10/1987 Alvondrovandi et al. ..... 417/63
5,067,879 11/1991 Carpenter ..... 417/477.1
5,103,211 4/1992 Daoud et al. ..... 417/63
5,657,000 8/1997 Ellingboe ..... 417/63

*Primary Examiner*—Charles G. Freay
*Assistant Examiner*—Trelita Perry
*Attorney, Agent, or Firm*—Myron Amer PC

[57] ABSTRACT

A peristaltic pump delivering a medicant through a plastic tube with an appropriate wall thickness to withstand external rubbing contact with the rotating rotor of the pump, in which downstream of the rotor a tubing length is used in the plastic tube having a thinner wall thickness so that when a downstream occulsion is detected, the pressure build-up transmitted upstream to the tubing length more readily causes it to undergo an expansion radially because of its thinner wall to actuate an on-off switch of the peristaltic pump.

6 Claims, 2 Drawing Sheets

OCCLUSION DETECTION MEANS FOR A PERSISTALTIC PUMP

The present invention relates to improvements in peristaltic pump operation, the improvements more particularly relating to facilitated means for stopping the pump in the event, which can reasonably be expected because it is of a common occurrence, of an occlusion downstream of the pump.

EXAMPLE OF THE PRIOR ART

An inadvertent occlusion in the plastic tube through which medicant is pumped by a peristaltic pump is a well known occurrence, as documented in U.S. Pat. No. 4,369,780 issued for "Blocking Condition Detection Device In A Medical Fluid Injection System" to Eiichi Sakai on Jan. 25, 1983. It is also well known that the occlusion, occurring downstream of the pump, causes an upstream pressure build-up and a corresponding radial expansion in the plastic tube. This radial expansion is attempted in the prior art to actuate an off switch terminating operation of the peristaltic pump, but is not significantly successful in achieving this end purpose.

Underlying the present invention is the recognition that because the wall thickness of the plastic tube must be of an appropriate extent to serve its primary function as a fluid passage, that the radial expansion thereof caused by an occlusion is resisted by the wall thickness and is not, in all cases, of a sufficient extent to urge a movable switch contact in movement into contact with a stationary contact of an off switch to terminate the pumping function of the peristaltic pump.

Broadly, it is an object of the present invention to provide an occlusion detector for a peristaltic pump overcoming the foregoing and other shortcomings of the prior art.

More particularly, it is an object to use to advantage the flexibility of the plastic tube in a selected length portion, and to embody the wall thickness of said length portion in better condition to partake of radial expansion to a significantly increased extent so as to achieve actuation of the motor off switch, i.e., stated somewhat differently it is easier to blow up a balloon than it is to blow up a tire, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figures 1, 3, 4, 5:
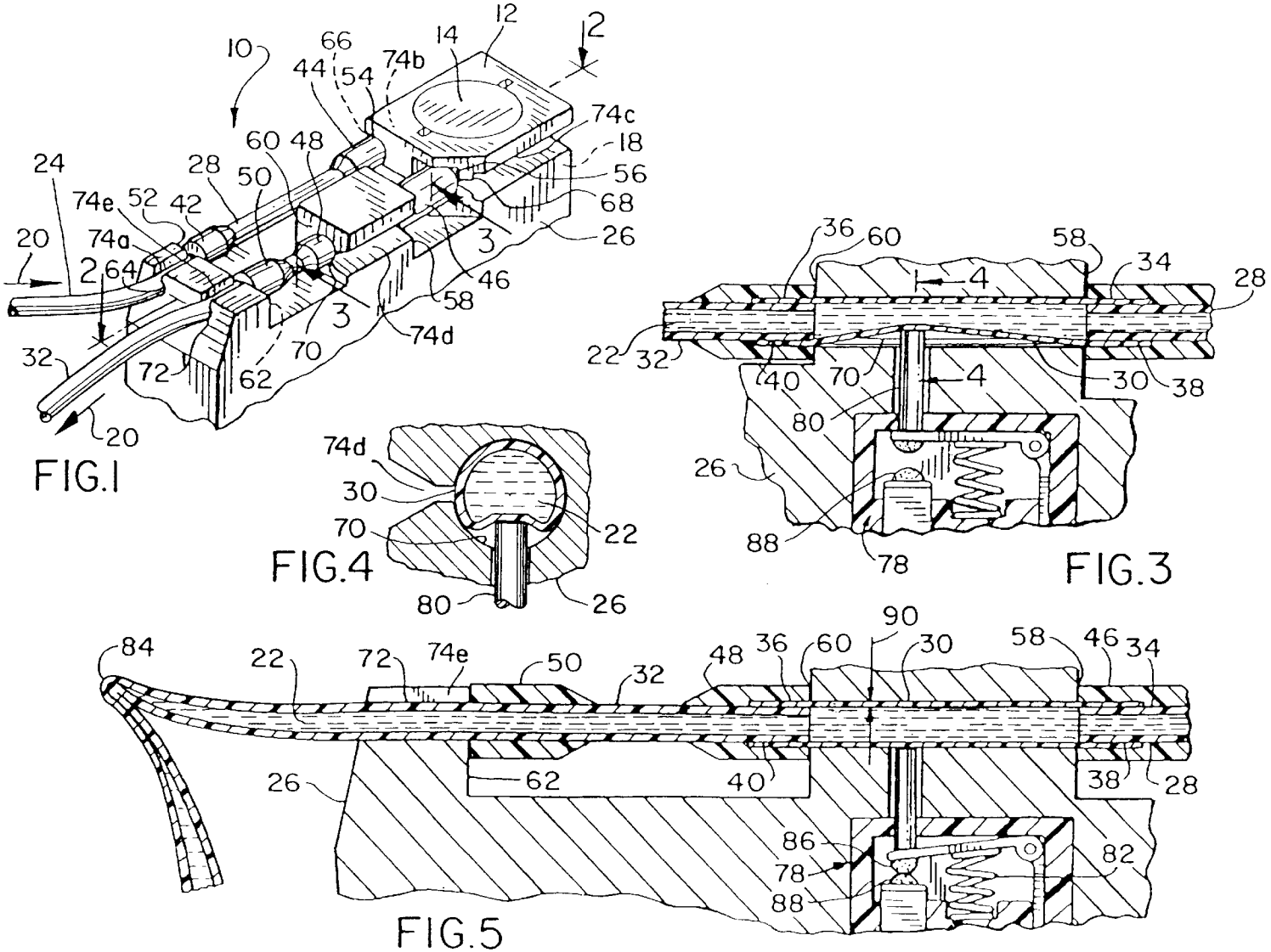
FIG. 1 is a partial perspective view of a peristaltic pump and an occlusion detector in accordance with the present invention.
FIG. 3 is a sectional view taken along line 3—3 of FIG. 1.
FIG. 4 is a sectional view taken along line 4—4 of FIG. 3 illustrating a first condition of a plastic tube component and a switch component.
FIG. 5 is an extended sectional view similar to FIG. 3 illustrating the occurrence of an occlusion in the plastic tube.

The within inventive occlusion-detection device, both located at and generally designated 10, is embodied in a peristaltic pump 12, the construction and operational mode of which is generally well known and documented in the prior patents, such as U.S. Pat. No. 4,369,780 for Blocking Condition Detection Device In A Medical Fluid Injection System issued to Eiichi Sakai on Jan. 25, 1983, to mention but a few. Pump 12 has a rotor 14 with radial circumferentially spaced projections 16 effective when the rotor is driven in rotation by an electric motor 18, in this instance clockwise (See FIGS. 1 and 2), to urge a directional flow 20 of a selected fluid medicant 22.

A three part plastic tubing conduit 24 is provided in assembled condition and mounted on housing 26. Conduit 24 consists of an upstream $1^{st}$ section 28 with a wall thickness in a preferred embodiment of 0.040 inches in communication with a source of the medicant 22, a short $2^{nd}$ length of thinner wall tubing 30 with a wall thickness in a preferred embodiment of 0.020 inches which serves as the main element of the occlusion detector 10 and in the direction of flow having a first encountered inlet opening 34 and a second encountered outlet opening 36, and lastly a downstream $3^{rd}$ tubing section 32 with a wall thickness in a preferred embodiment of 0.040 inches which is used to deliver the medicant 22 to a patient (not shown). The upstream and downstream ends 34 and 36 of the tube length 30 are in cemented overlapping relation to respective ends of tubings 28 and 32, as at 38 and 40.

A series of five plastic annular stop sleeves 42, 44, 46, 48 and 50 are strategically located and cemented in place along conduit 24 to bear against vertical seats or shoulders provided in housing 26. In a downstream sequence, sleeve 42 bears against seat 52, sleeve 44 against seat 54, sleeve 46 against seats 56 and 58, sleeve 48 against seat 60, and sleeve 50 against seat 62. Stops 42–50 in cooperation with seats 52–62 hold in place conduit 24 in relation to housing 26.

Additionally, housing 26 is provided with a series of confining notches 74*a*–*e* for the containment of conduit 24. These notches provide access to respective compartments 64, 66, 68, 70 and 72. Notch 74*a* is of particular utility as will now be described in relation to FIGS. 6–9.

More particularly, this now to be described utility, and what will be understood to underlie another aspect of the present invention, is the recognition that the lengthwise stretchability provided by the construction material of the tube length 30 can be used to advantage in positioning the tube length within the switch housing compartment 70 while obviating any undesirable bulging of the positioned tube out of the switch compartment 70 during the detection of an occlusion 84.

Figures 2, 6, 7, 8, 9:
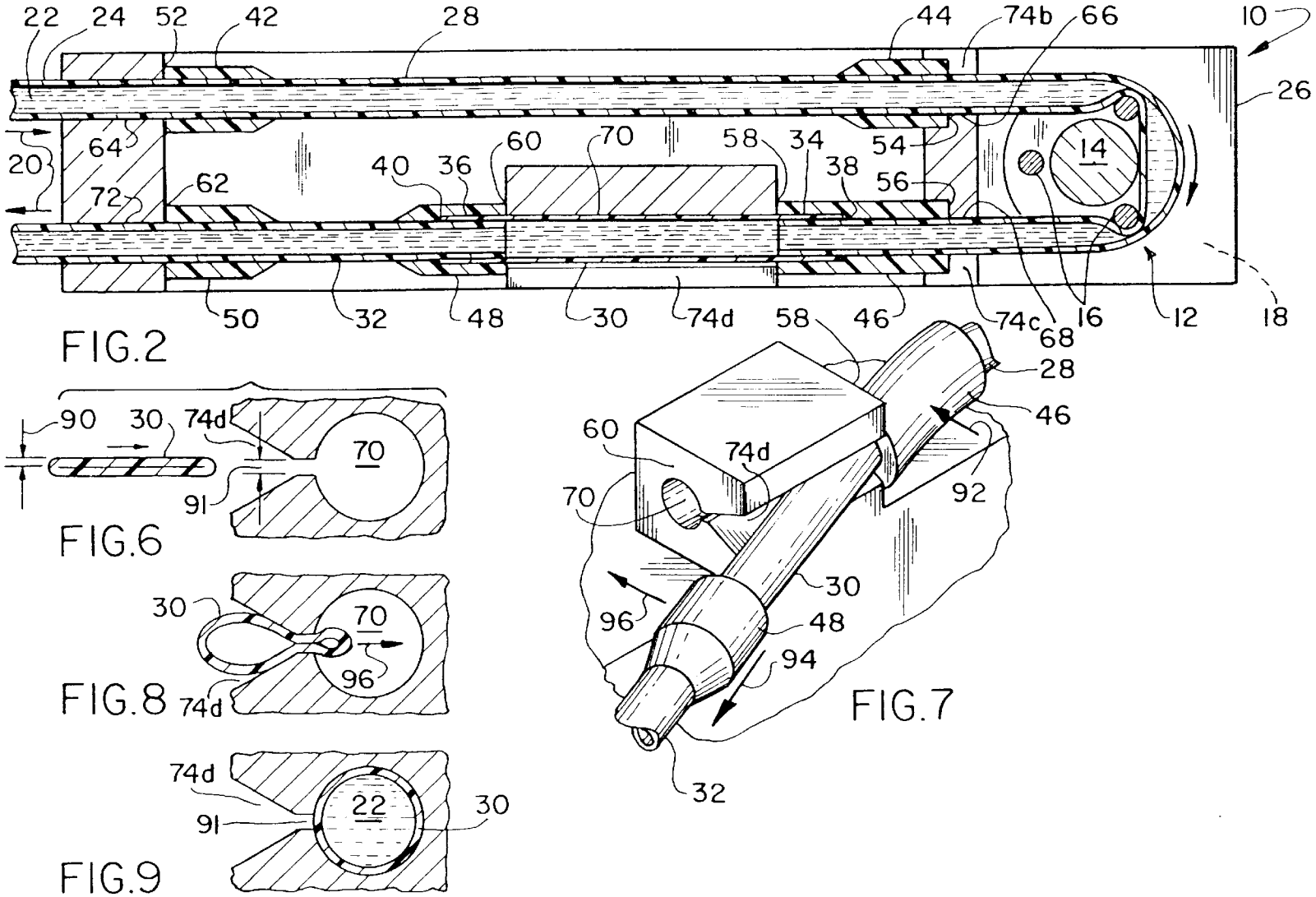
FIG. 2 is a sectional view taken along line 2—2 of FIG. 1.
FIG. 6 is a sectional view similar to FIG. 4 but illustrating a subsequent condition of the plastic tube component.
FIG. 7 is a perspective view of an initial step in the assembly of the device.
FIG. 8 is a view similar to FIG. 6 illustrating an intermediate step of the assembly procedure.
FIG. 9 is a view similar to FIG. 6 illustrating the final step in the assembly procedure.

When the three part conduit 24 is assembled on housing 26, the first step is to locate thin wall section 30 within compartment 70. Removed construction material from the front wall of the through bore for the switch results in edges which bound therebetween an opening or rectangular notch 74*d* opening into the two cooperating semi-circular halves of the compartment 70, the dimension of the notch 74*d* being selected, in a preferred embodiment, not to exceed 0.036 inches, a dimension which is less than twice the wall thickness 90 (2×0.020") of tube section 30. Normally the flattened tube 30 would not be able to pass into compartment 70 as illustrated in FIG. 6. To insert tube 30 within compartment 70, stop 46 is pressed in the direction of arrow 92 (FIG. 7) to rest against seat 58. Tension is applied to the left as per arrow 94 in combination with a clockwise force 96. This causes a thinning of wall 90 so that now the double wall thickness (FIG. 8) will easily move into compartment 70. When stop 48 is allowed to abut against its cooperating seat 60 the tube section 30 now assumes the circular shape of circular compartment 70 and cannot, even under pressure, protrude out of notch 74*d* which thereupon confines the exertion of its pressure on pin 80 to operate switch 78 when occlusion 84 occurs.

After the occlusion detection tube section 30 has been allowed to assume its original configuration, filling compartment 70, the peristaltic pump section or tubing 28 is helically wrapped around the pump rotor 14 with stop 44 abutting against seat 66. Stop 42 is brought against seat 52, stop 50 against seat 62 and tubings 28 and 32 are connected to the medicant source and the patient respectively.

Thus, it has been found in practice that when detecting an occlusion 84, the upstream pressure build-up does not result in the tube length 30 bulging laterally through the 0.036" opening because of the size differences between the opening and the double wall thickness of the tube 30. In this regard, to protrude from the opening, the tube 30 must fold which results in the double wall thickness referred to. Not only does the obviating of a bulge minimize rupture of the tube length 30, but it contributes to the full utilization of the occlusion-produced pressure buildup to urge switch 78 in descending closing movement against switch contact 88, thus enabling the detection of slight as well as significant occlusions.

Although providing the noted size differences and using to advantage the stretchability of the wall thickness of the tube 30 to facilitate movement into the compartment 70 is the preferred manner of assembling the occlusion detection device 10, it has been found that less favorable, but nevertheless usable, results can be achieved without using any size differences or even using a size difference in favor of the compartment opening or notch 74*d*, i.e. the selected notch 74*d* size is slightly greater than the double fold thickness of the tube 30. To this end, it has been observed in practice that a tube 30 positioned in the compartment 70 and under a pressure exerted against a portion of the wall of the tube that is flat against the inside of the notch or opening 74*d* cannot push it in a bulge configuration through said notch or opening 74*d* because the bulge configuration is v-shape in cross section with the point or tip of the v-shape protruding slightly within the notch or opening 74*d*, but prevented from protruding further by wall portions forming the "v" shape of the bulge configuration. Stated somewhat differently, the size of the tip of the v-shape is of a minimum extent, but in the direction extending rearwardly therefrom and coextensive with the manifested "v" shape, the size of the bulge configuration progressively increases and ultimately exceeds the size of the opening 74*d* so that a protruding bulge never occurs.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An occlusion detector for a peristaltic pump comprising a peristaltic pump having a circular rotor journalled for rotation, an electric motor operatively connected to power said rotor in rotation so as to cause a directional flow of a medicant, a switch housing having walls bounding a semicircular compartment and in said directional flow a first encountered inlet opening into said compartment and a second encountered outlet opening out of said compartment, a first hollow length of tube of a specified wall thickness of an extent effective to obviate damage thereto during pumping service of said peristaltic pump having an inlet opening in communication with a source of said medicant and after a helical turn about said rotor having an outlet opening located adjacent to said switch housing inlet opening, a second hollow length of tube of said similar specified wall thickness having an inlet opening in communication with said switch housing outlet opening and an outlet opening in communication with a site of use of said medicant, a switch means projected into said switch housing compartment operatively effective to be urged in descending movement in response to a pressure build-up as caused by an occlusion in said second tube length, and a third hollow length of tube connected to extend through said switch housing compartment in contact with said switch means and characterized by a reduced wall thickness of half the thickness of said specified wall thickness of said first and second tube lengths and having a first end in communication with said first tube outlet opening and a second end in communication with said second tube inlet, whereby there is minimal resistance of said third tube wall thickness to said occlusion-detecting descending movement of said switch means.

2. An occlusion detector as claimed in claim 1 consisting of a body operatively disposed along said flow path in a downstream location from said peristaltic pump, an open ended through bore in said body providing a circular wall bounding a compartment for the positioning therein of said third hollow tube of a specified wall thickness and of stretchable construction material, a removed extent of said circular compartment wall providing parallel spaced apart edges bounding therebetween an opening of a specified extent opening into said compartment, said third tube having a wall of a selected thickness in relation to said specified extent of said compartment opening to provide nominal clearance in any movement through said opening into and out of said compartment, and an operative stretched condition of said third tube effective to diminish said wall thickness thereof to an extent less than said specified extent of said compartment opening, whereby said third tube is adapted to be positioned in said compartment in said stretched condition and after which assumes said unstretched condition so as to be securely held in place in said compartment.

3. An occlusion detector as claimed in claim 2 wherein said thickness of said third tube wall is selected in a folded configuration to exceed said opening of a specified extent opening into said compartment.

4. An occlusion detector as claimed in claim 2 wherein said thickness of said third tube is selected in a folded configuration to equal said opening of a specified extent opening into said compartment.

5. An occlusion detector as claimed in claim 2 wherein said selected thickness of said third tube is sized in a folded configuration to provide an optimum minimum clearance in movement through said opening of a specified extent opening into said compartment.

6. An occlusion detector as claimed in claim 1 in which said specified wall thickness of said first hollow length of tube is approximately 0.040 inches, and said reduced wall thickness of said third hollow length of tube is not greater than 0.020 inches.

* * * * *